US006427750B1

(12) United States Patent
Butler

(10) Patent No.: US 6,427,750 B1
(45) Date of Patent: Aug. 6, 2002

(54) DISPLAY UNIT

(75) Inventor: Edward Maurice Pierce Butler, Buckinghamshire (GB)

(73) Assignee: Powergraphics Display Limited, Buckinghamshire (GB)

( * ) Notice: Subject to any disclaimer, the term of this patent is extended or adjusted under 35 U.S.C. 154(b) by 0 days.

(21) Appl. No.: 09/846,541

(22) Filed: May 1, 2001

(30) Foreign Application Priority Data

Nov. 10, 2000 (GB) ..... 0027592

(51) Int. Cl.[7] ..... A47G 5/02
(52) U.S. Cl. ..... 160/241; 160/85; 160/122
(58) Field of Search ..... 160/85, 86, 120, 160/122, 241, 310

(56) References Cited

U.S. PATENT DOCUMENTS 132,726 A * 11/1872 Landon ..... 160/241
207,520 A * 8/1878 Hedges ..... 160/241
1,539,774 A * 5/1925 Sato ..... 160/241
2,668,586 A * 2/1954 Luckie ..... 160/241
3,386,489 A * 6/1968 Denton et al. ..... 160/241
4,766,941 A * 8/1988 Sloop et al. ..... 160/241
4,813,198 A * 3/1989 Johnston et al. ..... 160/241 X
5,347,732 A * 9/1994 Padawer ..... 160/241 X
5,392,549 A * 2/1995 Castro ..... 160/241 X
5,538,065 A * 7/1996 Geraud ..... 160/241 X
5,735,328 A * 4/1998 Salhoff et al. ..... 160/241 X
5,752,557 A * 5/1998 Crider et al. ..... 160/85 X

* cited by examiner

*Primary Examiner*—Bruce A. Lev
(74) *Attorney, Agent, or Firm*—Robert L. Epstein; Harold James; James & Franklin, LLP

(57) ABSTRACT

An advertising display unit has a blind wound between a pair of spaced rollers rotatably mounted for bringing a selected portion of the blind into a display window area. A mechanism for longitudinally moving the blind is provided which is easily accessed and actuated manually. Each roller comprises an assembly having a larger diameter portion onto which the blind is wound and a smaller diameter portion that rotates with it. A cord drive is secured to and wound a number of turns round the smaller diameter portion of one roller. The cord drive follows a path a section of which extends externally of a housing in which the rollers are mounted. The cord drive passes to the other roller where it is wound a number of turns about and secured to the small diameter portion of the other roller. The cord is wound about the small diameter portion so as to wind off one and onto the other with the rollers rotating in the same direction. The blind serves to transmit drive from the wind-up roller to the wind-off roller. The external section of the path includes a manually-graspable handle in which the cord is secured by a spring-loaded mechanism to maintain tension in the cord.

8 Claims, 3 Drawing Sheets

DISPLAY UNIT

FIELD OF THE INVENTION

This invention relates to a display unit. More particularly the invention is concerned with a display unit of the kind in which a blind printed with display material is windable between a pair of rollers for presenting a selected area of the blind for display in a frame or window area.

BACKGROUND TO THE INVENTION

Roller blind displays have been widely used for many purposes including advertising and presentation of information. In such displays a blind carries a sequence of displays along its length. It is wound between a pair of parallel spaced rollers through a display window area, the blind being wound off one roller onto the other. Various controllable drive mechanisms have been used conventionally driven by an electric motor. Such drive mechanisms including indexing means to halt the drive when a selected portion of the blind is in the display window area. The present invention seeks to provide a drive mechanism which is reliable and easy to use and, in particular, one which can be manually actuated.

The present invention is applied to a display apparatus of the kind comprising first and second rollers rotatably mounted in spaced parallel relationship for winding a blind carried by the rollers therebetween through a display area to locate a selected portion of the blind thereat; and drive means for rotating one or other roller to cause lengthwise movement of the blind.

SUMMARY OF THE INVENTION

In accordance with the present invention in display apparatus of the above kind, the drive means comprises first and second drive portions rotatable with said first and second rollers respectively, said first and second drive portions being located at opposite sides of the rollers as seen from the display area.

A flexible elongate drive element is terminated at one end at the first drive portion, and is wound in a plurality of turns about the first drive portion. The drive element is terminated at the other end at the second drive portion and is wound in a plurality of turns about the second drive portion so as to be wound thereon when the drive element is wound off the first drive portion and vice versa. The drive element has an intermediate section-supported for lengthwise movement thereof in a predetermined path between the turns wound on the first and second portions and the predetermined path includes a portion at which the intermediate section is manually actuable to apply a drive force to one or other of the rollers.

The blind carried by the rollers may be a carrier for graphics, e.g. a printed display blind attached to the carrier blind. The carrier blind acts to transmit drive from the roller to which drive is applied to wind the carrier thereon to the other roller from which the blind is being wound off. The display apparatus may be constructed in the form of a light box in which the carrier blind is back lit. To this end the carrier blind is made light transmissive.

In a preferred embodiment of the display apparatus of the invention the above-mentioned portion of the predetermined path is substantially parallel to and in the plane of said first and second rollers outside the space between the rollers occupied by the blind. More particularly the rollers are supported in a rectangular housing parallel to and adjacent respective ones of two opposed sides thereof and the portion of the predetermined path lies external to one of said two opposed sides to be manually accessible. One of these two opposed sides contains first and second apertures through which the flexible element extends to the external portion of the predetermined path. Manually-engageable (e.g. graspable) means is carried by the flexible element at the external portion of said predetermined path.

The manually-engageable means is sized to be unable to pass through the apertures and thereby limits the extent of movement of the manually-engageable means. Preferably the manually-engageable means is a spring-loaded device acting to maintain tension on the flexible element. In the preferred embodiment of the invention the flexible element extends from the first drive portion in a direction past the second roller and extends from said second drive portion to engage a part acting as a guide pulley rotatable with the first drive roller and return towards and past the second drive portion.

Furthermore in the preferred embodiment of the display apparatus the ratio of the diameter of each of the first and second rollers to the diameter of each of the first and second drive portions respectively is such that a movement of the flexible element through a distance between said apertures causes the blind to be wound over a length that is at least twice the dimension of said display area in the lengthwise direction of the blind.

DESCRIPTION OF THE PREFERRED EMBODIMENT

Figure 1:
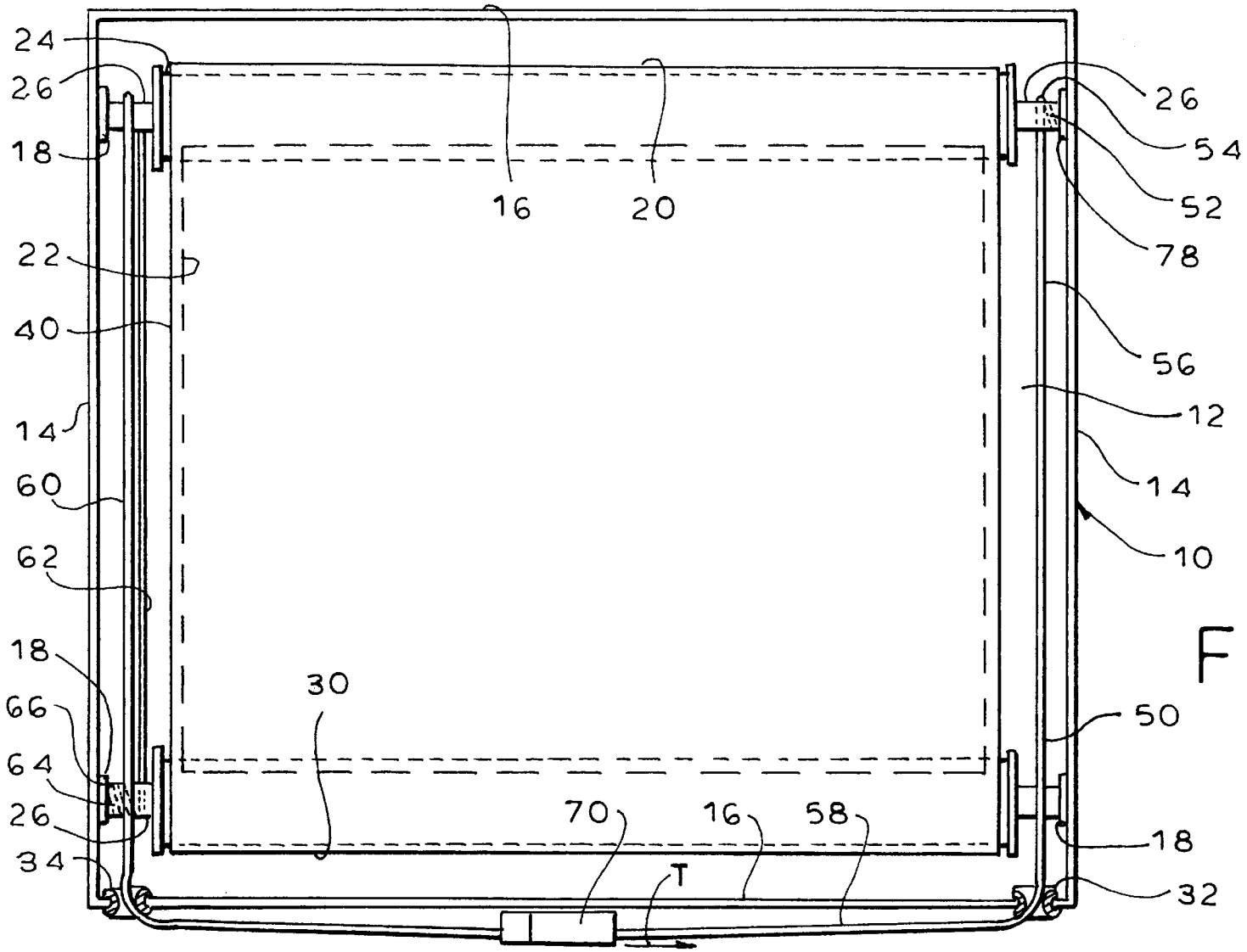
FIG. 1 is a front elevation of a display unit embodying the invention with the front cover removed.

There will be described an embodiment of the invention in which the invention is applied to what is known as a light-box type of display unit. A light-box provides back lighting of the displayed portion of a blind carrying display material. It will be assumed that the blind that is moved to change the display is movable in a vertical path between upper and lower rollers. Reference to the "left" and "right" and "upper" and "lower" refer to the display unit as seen in FIG. 1. The unit to be described could be mounted to provide a display in which the blind is moved horizontally.

FIG. 1 shows a display unit having a housing 10 formed to provide a rectangular tray in which the mechanism of the display unit is mounted. That is the housing includes a rear wall 12 and side vertical walls 14 and horizontal side walls 16 upstanding from the rear wall. Mounted in the housing parallel to and adjacent respective side walls 16 is an upper roller assembly 20 and a lower roller assembly 30 parallel to the upper roller and spaced from it. Both rollers are rotatably mounted to releasable plain bearings 18 supported on the opposed vertical side walls 14 for rotation about a horizontal axis. The structure is shown simplified in FIG. 1. A preferred arrangement for the support and rotation of the roller assemblies 20 and 30 (including their respective drive means) is described below with reference to FIG. 2. The rollers 20 and 30 receive a graphic carrier 40 which is in the form of a blind and which is windable from one roller to the other to present a portion of the blind in a display window area 22 indicated in dashed line. The display window area 22 is defined by a front cover or surround (not shown) attachable to the housing 10. The end portions of the graphic carrier 40 are secured to respective rollers, as by pop type rivets. The carrier 40 transmits the drive applied to one roller to the other and serves to carry a display blind (not shown) on which the advertising or information to be displayed is printed. The display blind is attached to the outer surface of the carrier 40 by releasable means (not shown) such resilient plastic tongue and groove arrangements such as are well known. The front cover screens the rollers and their operating mechanism from external view so that only the wanted display portion of the blind is seen at display area 22. The housing 10 and the front cover provide what is known as a light box. The graphics carrier 40 extends between the outer portions of the rollers, i.e. away from rear wall 12. The carrier 40 is a translucent plastics web which supports both the tension generated in the web between the rollers 20 and 30 during movement of the carrier and diffuses light to allow back lighting of the display blind. To this end, back lighting is provided by lamps such as elongate fluorescent lamps (not shown), carried by the rear wall 12 behind the display window area 22. The depth of the tray that is the height of the side walls 14 and 16 from the base 12, is sufficient to allow the rollers 20 and 30 to be accommodated within the tray such that the plane of the carrier 14 therebetween is a little within the tray. This is not essential but is of advantage in the provision of a front cover or surround of straight forward construction.

The roller assemblies 20 and 30 are conveniently of identical construction as exemplified by the following description of roller assembly 20. The assembly 20 has a larger diameter portion 24 onto which the carrier 40 is wound and an integral reduced diameter portion 26 at each end of the larger diameter portion which is mounted to rotate in a plain bearing aperture of a respective bearing 18 in a construction to be described with reference to FIG. 2. All the parts of a roller assembly rotate as a unit. Not all the parts are used in the drive arrangement: it is convenient, however, to manufacture the roller assemblies to be identical and for each to be symmetrical.

In order to rotate the two rollers simultaneously, a manually-operable cord drive So is provided as a flexible drive element. The cord drive is secured at one end 52 to the reduced diameter portion 26 at the right side of the upper roller 20 and the end portion is wound a number of turns 54 around the adjoining reduced diameter portion 26 from whence the cord extends along an intermediate path which leads down as indicated at 56 inside the adjacent side wall 14 to exit the lower side wall 16 through an apertured bush 32 (shown in cross-section) fitted in the side wall and below the reduced diameter portion at the right of the figure. The cord 50 then extends in a portion 58 exterior to the lower side wall 16 across to and through another apertured bush 34 (shown in cross-section). Having passed through the bush 34 the cord 50 passes the lower roller assembly and rises at 60 to pass round the reduced diameter portion 26 at the left of the upper roller assembly 20—the portion 26 there acting as a guide pulley—and thence down at 62 to the reduced diameter portion 26 at the left of the lower roller assembly 30. This end portion of the cord is treated in the same way as the other end portion 64 first described. It is wound several turns 64 around the reduced diameter portion 26 at the right of the lower roller 30 and the other end 54 of the cord 46 secured to this portion 26. The wound portions of 54 and 64 of the cord 50 are wound in a direction enabling both rollers to rotate in the same direction, thereby winding the carrier 40 between them. The apertured bushes 32 and 34 are formed and are located below the reduced diameter portions 26 to assist a smooth longitudinal sliding motion of the cord 50 through the bushes.

It will be seen that the intermediate path traversed by the cord is designed to allow ease of longitudinal movement and free winding/unwinding of the turns on drive portions 26. The intermediate path lies essentially in a single plane and for compactness of the unit this plane is the plane in which the rollers 20 and 30 are located. The cord drive 50 extending from bush 34 could be taken directly to the drive portion 26 at the left of lower roller 30 but by taking it up over the drive portion 24 at the right of the upper roller 20 and back down to the lower roller variation in the angle which the cord makes to the drive portion 24 of the lower roller as it winds/unwinds is reduced aiding in ensuring free movement.

The section 58 of the cord outside the housing 10 provides the means by which it is manually-accessible for moving the cord lengthwise. The section 58 lies essentially in the plane of the rollers 20 and 30 and the housing 10 and is outside the spacing between the rollers within which the display area 22 is defined. A tension applied in the cord as indicated by arrow T will act to unwind the cord with respect to one roller, 30 in the case shown, and cause the carrier to be wound onto that roller. The resultant tension in the carrier 40 is communicated to the other roller and acts to wind the carrier off the other roller 20. This in turn causes the winding up of the cord at 54 at the right of roller 20.

A means 70 is provided on the cord in the external section 58 between apertures 32 and 34 to act as a manually grippable element to move the cord and/or to act as a cord tensioning element. In the embodiment shown, the means 70 does not pass through the apertures and acts as a stop member to limit the amount of longitudinal travel of the cord 50. Preferably it performs all three functions. In the preferred embodiment the means 70 is a spring-loaded cord tensioning device described below with reference to FIG. 3.

This manual actuation requires no indexing of the blind as has been used in controlling motor-driven blind-winding systems. The person moving the cord watches the display and sets it to the required position. The system is particularly useful for displays which do not require continual change, for example menu displays which are changed at intervals during the day.

The length L of carrier moved in traversing the cord tensioning device between the apertures 32 and 34 over a distance D is related to distance D by the ratio R of the diameter of the larger diameter portion 24 of a roller assembly (about which the blind is wound) to the diameter of the adjoining smaller diameter portion 26 about which the cord is wound. Thus L=RD. L is sufficient to accommodate N displays lengthwise along the blind each of which occupies the height H (in the carrier travel direction) of the display window area 22. Thus L is not less than NH.

Figure 2:
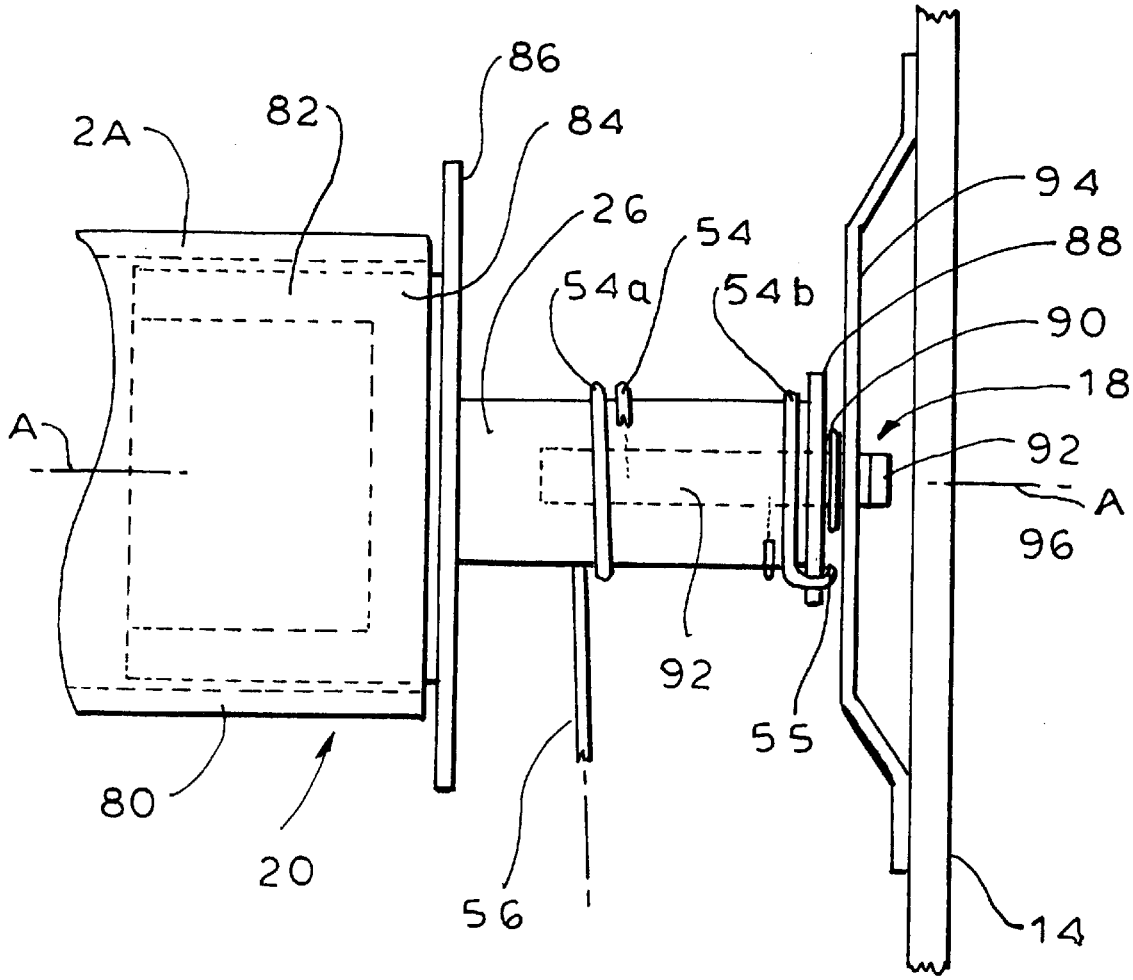
FIG. 2 is an illustration to a larger scale of the means for rotatably supporting the rollers at each end, the illustration of FIG. 2 particularly pertaining to the right-hand end of the upper roller as seen in FIG. 1.

FIG. 1 illustrates the mounting of the roller assemblies rather diagrammatically. A preferred roller support and rotational mounting will now be described, taking the right hand side of the upper roller assembly by way of example. Each roller end is supported and mounted in the same fashion. FIG. 2 also illustrates the winding of the drive cord onto the reduced diameter portion at the right hand side of the roller assembly 20. The carrier blind 40 is not shown. In FIG. 2 parts like to those of FIG. 1 are denoted by like reference numerals.

FIG. 2 shows the section of right-hand side wall 14 adjacent the right hand end of the upper roller assembly 20. The larger diameter portion of the roller comprises a cylindrical tube 80 of aluminium whose end portion is a snug slide fit on to an inwardly projecting cylindrical portion 82 of a member 84 which is inserted into the tube until the tube abuts an outwardly directed flange 86. Portion 82 is shown as tubular: it could be solid. The tube 80 and insert 82 may be keyed together to ensure they rotate as a unit about axis A—A. The member 84 has the drive portion 26 extending axially outwardly from flange 86. The outer end of portion 26 carries a flange 88 and projecting from this is a raised axial boss 90. The outer end of portion 26 has an axial blind hole extending into it through boss 90 and flange 88. A metal spigot 92 is received in the blind hole and projects outwardly to enter the plain bearing 18.

The bearing 18 is formed in a bracket 94 fixed to and standing away from the inner surface of adjacent side wall 14. The bracket 94 is apertured in alignment with axis A—A and an apertured bush 96 seats in the bracket aperture with an enlarged flange portion 98 axially inward to engage the facing surface of boss 90 for smooth rotational engagement therewith. The spigot 92 extends outwardly of boss 80 to enter the bearing bush 86. The member 84 (parts 82, 86, 26, 88 and 90) is formed as an integral moulding of plastics material, e.g. Teflon, and the bearing bush 96 is likewise formed of a plastics material such as Teflon.

The structure described above with reference to FIG. 2 is designed for ease of rotation bearing in mind that ease of manual actuation is required.

To complete the drive portion 26 shown in FIG. 2, there is also shown the rising cord portion 56 which engages the portion 26 at the rear (as seen in the figure) and is wound in a plurality of turns 54 of which only the first and last 54*a*, 54*b* are shown for clarity of illustration. The end of turn 54*b* is then taken through an aperture in flange 88 and is suitably terminated for example in a knot 55 to retain the end in place and anchor the turns 54 to portion 26. The flange 88 acts to prevent the wound cord from sliding off the drive portion 26.

The flange 86 acts to locate the carrier and the display blind affixed thereto against any tendency for axial displacement. Preferably the aperture in the bracket 94 is provided with a releasable side portion so that the bush 96 and the spigot 92 within it are releasable from the bracket in order to remove the roller assembly as a unit. This provision is made on all four apertured brackets.

Figure 3:
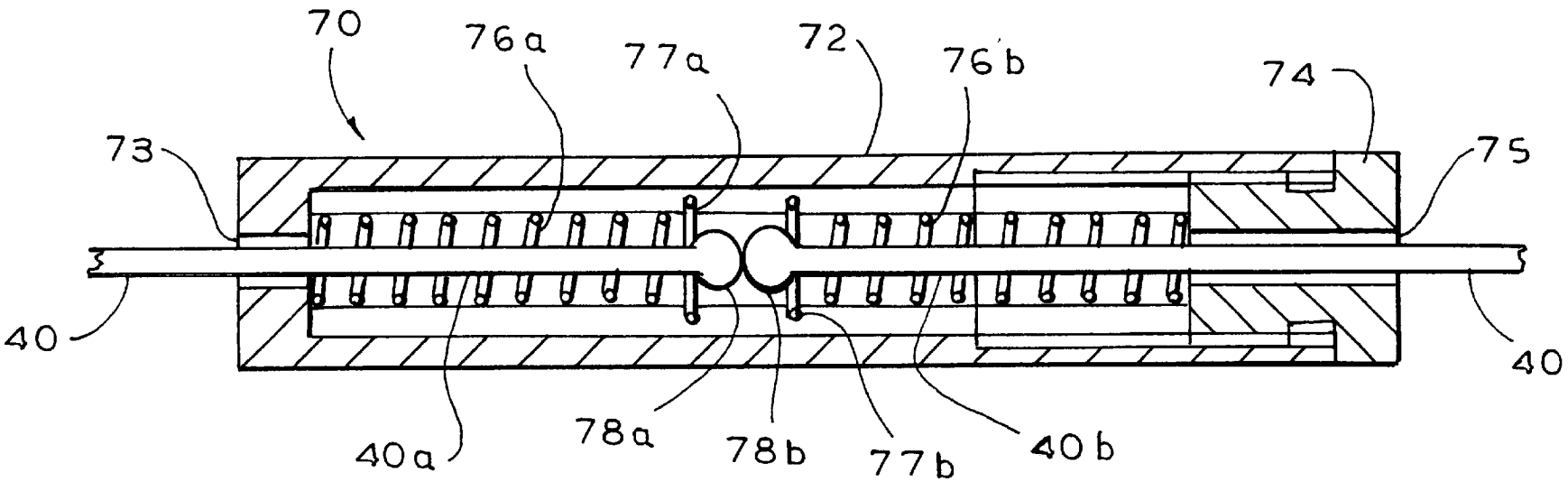
FIG. 3 is an axial section of a handle/tensioning device for the drive cord.

The construction of the combined handle/tensioning device 70 is illustrated in FIG. 3. It is considered to be novel in its own right. The device 70 comprises a tubular body 72 closed at one end. The closed end has a central aperture 73 allowing the cord 40 to enter the body from one side (FIG. 1). The other end of body 72 is interiorly threaded to receive a screw-in cap 74 which is also centrally apertured at 75 to allow the cord 40 to enter the handle from the other side. Within the body 72 are two helical springs 76*a*, 76*b* aligned in the body 72, their outer ends bearing against the inner surfaces of the closed end of the body 72 and the cap 74. The cord 40 is separated into two within the handle. One end portion 40*a* of the cord passes through the helical spring 76*a* and through the aperture of a washer 77*a* engaging the inner end of the spring 76*a*. The end of cord portion 40*a* is tied into a knot 78*a* interiorly of washer 77*a* so that the cord end is retained by the washer. Similarly the other end portion 40*b* of cord passes through the helical spring 76*b* and through the aperture of a washer 77*b* engaging the inner end of the spring 76*b*. The end of cord portion 40*b* is tied into a knot 78*b* interiorly of washer 77*b* so that the cord end is retained by the washer. The washers are axially movable in the body 72 to compress the respective springs. This construction has the advantage that by unscrewing the cap 74, the interior assembly can be removed from body 72. The handle effectively provides a continuous drive cord 40 in which a tension-maintaining resilience is incorporated.

In practice the handle can be set up to have the cord knots 78*a*, 78*b* a little separated to establish tension in the cord 40 and provide a degree of yielding enabling tension to be maintained in use of the apparatus. It is preferred to have the cord exit the lower side of the housing with the handle 70 accessible below the lower side, so that similar display units can be placed side by side in close proximity.

It will be appreciated that the rollers could be journalled to bearings provided directly in the side walls 14. The apertures 32 and 34 could be substituted by curved cord guides extending out of the lower side wall. The embodiment described utilises a graphic carrier which is affixed to the roller assemblies 20 and 30. With the aluminium roller tubes, e.g. 80, described the carrier 40 can be affixed thereto by pop rivets. While it is preferred to have a graphics carrier by which the display blind is carried in a two layer composite, a single layer display blind could be used. A light box type of construction is not essential for the practice of the invention.

I claim:

1. A display mounting apparatus comprising: first and second rollers rotatably mounted in spaced parallel relationship or a housing, a blind carried and wound by the rollers therebetween through a display area to locate a selected portion of the blind thereat; and driving means for rotating the rollers to cause winding movement of the blind; said driving means comprising first and second drive portions rotatable with said first and second rollers respectively, wherein said first and second drive portions are located at respective opposite sides of the rollers as seen from the display area, and a flexible elongate drive element that is terminated at one end at said first drive portion, is wound in a plurality of turns about said first drive portion and that is terminated at the other end at said second drive portion where it is wound in a plurality of turns about said second drive portion so as to be wound thereon when said drive element is wound off said first drive portion, said drive element having an intermediate section supported for lengthwise movement thereof in a predetermined path between the turns wound on said first and second portions, said predetermined path including a portion at which said intermediate section is manually actuable to apply a drive force to the rollers.

2. The display apparatus claimed in claim 1 wherein said portion of the predetermined path is substantially parallel to and in the plane of said first and second rollers outside the space between the rollers occupied by the blind.

3. The display apparatus claimed in claim 2 wherein said rollers are supported in a rectangular housing parallel to and adjacent respective one of two opposed sides thereof and said portion of said predetermined path lies external to one of said opposed sides.

4. The display apparatus claimed in claim 3 wherein said one of said two opposed sides contains first and second apertures through which said drive element extends to said portion of said predetermined path, and manually-engaging means being carried by said drive element at said portion of said predetermined path.

5. The display apparatus claimed in claim 4 wherein said manually-engaging means is sized to be unable to pass through said apertures and thereby limit the extend of movement of said manually-engaging means.

6. The display apparatus claimed in claim 5 wherein said manually-engaging means is a spring-loaded device acting to maintain tension on said drive element.

7. The display apparatus claimed in claim 4 wherein each of the first and the second rollers has a diameter, each of the first and second drive portions has a diameter and wherein the ratio of the diameter of each of the first and second rollers to the diameter of each of the first and second drive portions, respectively, is such that a movement of said drive element through a distance between said apertures causes the blind to be wound over a length that is at least twice the dimension of said display area in the lengthwise direction of the blind.

8. The display apparatus claimed in claim 1 wherein said drive element extends from said first drive portion in a direction past said second roller and extends from said second drive portion to engage a part acting as a guide pulley rotatable with said first drive roller and return towards and past said second drive portion.

* * * * *